US012157034B2

(12) United States Patent
Davenport et al.

(10) Patent No.: US 12,157,034 B2
(45) Date of Patent: Dec. 3, 2024

(54) SYSTEMS AND METHODS FOR TRAINING AND TESTING LOWER EXTREMITIES

(71) Applicant: Cybernetic Sport Innovations LLC, Westborough, MA (US)

(72) Inventors: Shane Davenport, Westborough, MA (US); Sean Smith, Westborough, MA (US)

(73) Assignee: Cybernetic Sport Innovations LLC, Westborough, MA (US)

( * ) Notice: Subject to any disclaimer, the term of this patent is extended or adjusted under 35 U.S.C. 154(b) by 0 days.

(21) Appl. No.: 17/711,829

(22) Filed: Apr. 1, 2022

(65) Prior Publication Data

US 2022/0314065 A1 Oct. 6, 2022

Related U.S. Application Data

(60) Provisional application No. 63/169,720, filed on Apr. 1, 2021.

(51) Int. Cl.

| | |
|---|---|
| ***A63B 23/04*** | (2006.01) |
| ***A63B 21/00*** | (2006.01) |
| ***A63B 21/068*** | (2006.01) |
| ***A63B 23/035*** | (2006.01) |

(52) U.S. Cl.

CPC ..... *A63B 23/0405* (2013.01); *A63B 21/068* (2013.01); *A63B 21/151* (2013.01); *A63B 21/4009* (2015.10); *A63B 21/4034* (2015.10); *A63B 23/03525* (2013.01); *A63B 2220/51* (2013.01); *A63B 2220/833* (2013.01)

(58) Field of Classification Search

CPC ..... A63B 21/0023; A63B 21/151; A63B 21/4009; A63B 21/4034; A63B 21/068; A63B 23/0405

See application file for complete search history.

(56) References Cited

U.S. PATENT DOCUMENTS 4,589,658 A * 5/1986 Gibson ..... A63B 21/4001 482/97
5,924,933 A * 7/1999 Pacheco ..... A63B 69/3608 473/277

(Continued)

OTHER PUBLICATIONS

Hangzhou Tianchen Scale Equipment, Digital blue-tooth function 300kg hanging crane scale [online], Published: Jul. 23, 2019. Retrieved from the Internet <URL: https://www.alibaba.com/product-detail/Digital-Blue-tooth-Function-300kg-Hanging_1600311598670.html?s=p> ( (Year: 2019).*

*Primary Examiner* — Zachary T Moore
(74) *Attorney, Agent, or Firm* — Bochner PLLC; Andrew D. Bochner

(57) ABSTRACT

The invention of the present disclosure may be lower extremity training system comprising a plate comprising an upper surface and a lower surface, a hook orthogonal to the upper surface, a strap reversibly coupled to the hook, and a belt reversibly coupled to the strap, wherein the strap includes a fixed length, and wherein a pull force, originating at the belt, exerted away from the upper surface induces one or more push forces towards the upper surface. A lower extremity testing system may further comprise one or more force sensors configured to capture and determine the magnitude of the one or more push forces.

17 Claims, 11 Drawing Sheets

(56) References Cited

U.S. PATENT DOCUMENTS

| | | | | |
|---|---|---|---|---|
| 7,608,025 | B1 * | 10/2009 | Best | A63B 21/0023 482/148 |
| 11,097,145 | B2 * | 8/2021 | Kelly | A63B 21/4033 |
| 2013/0153332 | A1 * | 6/2013 | Marzilger | A61F 5/3784 182/3 |
| 2019/0344115 | A1 * | 11/2019 | Neuhaus | A63B 21/0058 |
| 2019/0344123 | A1 * | 11/2019 | Rubin | A63B 21/4043 |
| 2020/0289873 | A1 * | 9/2020 | Charnitski | A63B 21/068 |

* cited by examiner

SYSTEMS AND METHODS FOR TRAINING AND TESTING LOWER EXTREMITIES

CLAIM OF PRIORITY

This application claims priority from U.S. Provisional Patent Application No. 63/169,720, filed on Apr. 1, 2021, the contents of which are incorporated herein by reference.

FIELD OF THE INVENTION

The present invention relates to lower extremity training and testing. Specifically, the present invention relates to training and testing lower extremity strength through force exertions on immovable objects.

INTRODUCTION

Training lower extremities can improve athletic performance. For example, thigh strength is associated with sprint speed and vertical jump performance. However, training lower extremities can be difficult or involve bulky equipment. For example, the equipment may occupy a lot of space and include a heavy rack that may be bolted to the ground.

Traditionally, such system may utilize an immobile rack and a substantial weight that would prevent the user from moving said rack. Next, the user would attempt to deadlift a bar attached to the immobile rack. However, such a system requires a number of heavy components requiring substantial setup effort and time. Further, such traditional systems are limited in that said systems are configured merely to train and/or measure the single metric of applied force. Thus, such traditional systems limit the user's mobility and free-range motion during training or testing sessions.

Moreover, traditional Isometric Mid-Thigh Pull (IMTP) includes a number of limitations, specifically limitations pertaining to the upper body. Accordingly, the involvement of the upper body and spine in traditional IMTP causes inaccurate readings regarding lower body force production. Such limitations with traditional IMTP emanate heavily from the fact that the user must utilize their arms and back when pressing upward against the immobile rack and bar. The use of upper extremities in this style of training and testing may cause grip and other upper extremity injuries. In addition to physiological limitations of such systems, traditional IMTP setups are costly due to the quantity and size of the required equipment. Such equipment often requires bolting the unit to flooring or loading the equipment with massive quantities of weights. Thus, setup is difficult, costly, and time consuming. As a further limitation, a user cannot easily evaluate their jump with such traditional systems. For example, to test an athlete's jump, one must relocate all the weights and then attempt to collect data. Further, in order to once again test strength, the weights must once again be loaded onto the IMTP rig. This alone may require several minutes because the user must re-calibrate the rig in order accurately collect data.

Therefore, it would be desirable to provide systems and methods configured to train lower extremity strength without cumbersome and unwieldy equipment. It would be further desirable to provide systems capable of both training lower extremity strength and measuring lower extremity strength. Even further yet, it would be desirable to provide a system capable of facilitating training and testing of a user's lower extremity strength in view of their mobility, such as jumping. Additionally, it would be desirable to provide a system for providing lower extremity training and testing while minimizing upper body muscle actuation.

SUMMARY

This Summary is provided to introduce a selection of concepts in a simplified form that are further described below in the Detailed Description. This Summary is not intended to identify key features or essential features, nor is it intended to limit the scope of the claims included herewith.

The invention of the present disclosure may be a lower extremity training system comprising a plate comprising an upper surface and a lower surface, wherein the lower surface is configured to interface with a floor. The lower extremity training system may further comprise a hook orthogonal to the upper surface, a strap reversibly coupled to the hook, and a belt reversibly coupled to the strap. The belt may be sized to conform to a waist of a user, wherein the strap includes a fixed length, and wherein a pull force, originating at the belt, exerted away from the upper surface induces one or more push forces towards the upper surface.

In an embodiment, the strap is reversibly coupled to the hook via a quick link, and the quick link may be disposed between the strap and the hook. The strap may be reversibly coupled to the belt via a coupling link, and the coupling link may be disposed between the strap and the belt.

In an aspect, the lower extremity training system further comprises a base disposed between the hook and the plate. The base may further comprise one or more mounting holes and a hook hole, wherein the one or more mounting holes may be threaded such as to accept one or more fasteners, the one or more fasteners may be configured to affix the base to the plate, and the hook hole may be sized to accept the hook. In a further embodiment, the hook may be welded to the base.

The invention of the present disclosure may be a lower extremity testing system comprising a plate comprising an upper surface and a lower surface, wherein the lower surface is configured to interface with a floor. The lower extremity testing system may further comprise a hook orthogonal to the upper surface, a strap reversibly coupled to the hook, and a belt reversibly coupled to the strap. The belt may be sized to conform to a waist of a user, wherein the strap may include a fixed length, and wherein a pull force, originating at the belt, exerted away from the upper surface may induce one or more push forces towards the upper surface. In a further embodiment, the lower extremity testing system comprises one or more force sensors configured to accept the one or more push forces and determine a magnitude of the one or more push forces.

In an embodiment, the plate further comprises one or more receivers sized to accept one or more mounts, wherein the one or more mounts are coupled to the one or more force sensors. In an aspect, the plate may further comprise one or more grip sections configured to accept one or more mounts, wherein the one or more mounts are couples to the one or more force sensors. In an embodiment, the plate further includes one or more apertures, a central section, and a perimeter, wherein the hook is disposed above the central section, wherein the perimeter surrounds the one or more apertures, and wherein the one or more grip sections are disposed on the perimeter.

In an aspect, the strap is reversibly coupled to the hook via a quick link, and the quick link is disposed between the strap and the hook. In another aspect, the strap is reversibly coupled to the belt via a coupling link, and the coupling link is disposed between the strap and the belt. In an embodiment, a base is disposed between the hook and the plate. The base may further include one or more mounting holes and a hook hole, wherein the one or more mounting holes may be threaded such as to accept one or more fasteners, where the one or more fasteners may be configured to affix the base to the plate, and wherein the hook hole may be sized to accept the hook. The hook may be welded to the base.

In an embodiment, the one or more force sensors is an inline force sensor, wherein the inline force sensor is coupled to the strap. The lower extremity testing system may further include a client device in electrical communication with the one or more force sensors, wherein the client device is configured to display a user interface, and wherein the user interface comprises one or more metrics, the one or more function being a metric of the magnitude of the one or more push forces.

In a further aspect, a border may surround at least the plate, wherein the border includes a border height, wherein the one or more force sensors include a sensor height, and wherein the border height is equivalent to the sensor height.

This disclosure describes systems and methods for training and testing lower extremities such as, but not limited to, thigh muscles. For example, a user can use the equipment for Isometric Mid-Thigh Pull (IMTP) testing. A user may put on a belt. The belt and strap are adjustable to accommodate differently sized users. For example, the belt can tighten around any waist size. The user can then attach the belt to a strap, and then attach the strap to a plate. The plate can include a set of force plates, and each force plate can include one or more force sensors. After attaching themselves to the plate via the belt, the user can stand on the plate and position themselves in a squatting position. The strap is adjustable to accommodate users having a height from four to eight feet. From the squatting position, the user can attempt to stand up, which would cause the belt to pull on the strap connected on the plate. Since the user stands on the plate while pulling, the user will pull up against their own bodyweight such that the plate acts like an immovable object because the user cannot lift themselves off the floor. Therefore, the user can use the systems and methods described herein to conduct jumps, IMTP, and other tests without relocating the force plates. By not moving the plates, the user does not need to calibrate, re-stabilize the plates or zero the sensors prior to use. Moreover, the systems and methods herein enable a safer and more accurate testing protocol in comparison with traditional IMTP testing methods. For example, by pulling from the midsection, the equipment enables the user to exert force with their thighs, which is the focus of IMTP tests. In contrast, other approaches may involve the user using their arms, which may cause the user's grip strength, lower back strength, upper body restrictions, and technical skill to influence the results. Additionally, the user is able to exert more force by using their legs instead of their arms.

An aspect of this disclosure provides for a training system. The training system can include a plate, a strap, and a belt. The plate may include the hook. The hook can attach to the strap. The strap can attach to the belt.

An aspect of this disclosure provides for a method of training lower extremities. A user may put on a belt around their midsection. The belt may attach to a strap. The strap may attach to a hook. The hook may be disposed on a plate. The user may stand on the plate, and pull up against their own bodyweight on the plate.

Another aspect of this disclosure provides for a testing system of lower extremities. The testing system may include a plate, a strap, a belt, a mount, and a force sensor. The plate may include the hook and the mount. The hook may attach to the strap. The strap may attach to the belt. The force sensor may be disposed on the mount. The force sensor may transmit force measurements to a client device.

An aspect of this disclosure provides for a method of testing lower extremities. A user can put on a belt around their midsection. The belt may attach to a strap. The strap may attach to a hook. The hook may be disposed on a plate. The plate may include a mount. A force sensor may be disposed on the mount. The user may stand on the force sensor, and pull themselves up by the belt against their weight on the force sensor. The force sensor may transmit, to a client device, force measurements corresponding to the pull force exerted by the user.

BRIEF DESCRIPTION OF THE DRAWINGS

Objects, aspects, features, and advantages of embodiments disclosed herein will become more fully apparent from the following detailed description, the appended claims, and the accompanying drawing figures in which like reference numerals identify similar or identical elements. Reference numerals that are introduced in the specification in association with a drawing figure may be repeated in one or more subsequent figures without additional description in the specification in order to provide context for other features, and not every element may be labeled in every figure. The drawing figures are not necessarily to scale, emphasis instead being placed upon illustrating embodiments, principles and concepts. The drawings are not intended to limit the scope of the claims included herewith.

DETAILED DESCRIPTION

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

It is noted that description herein is not intended as an extensive overview, and as such, concepts may be simplified in the interests of clarity and brevity.

All documents mentioned in this application are hereby incorporated by reference in their entirety. Any process described in this application may be performed in any order and may omit any of the steps in the process. Processes may also be combined with other processes or steps of other processes.

Figure 1A:
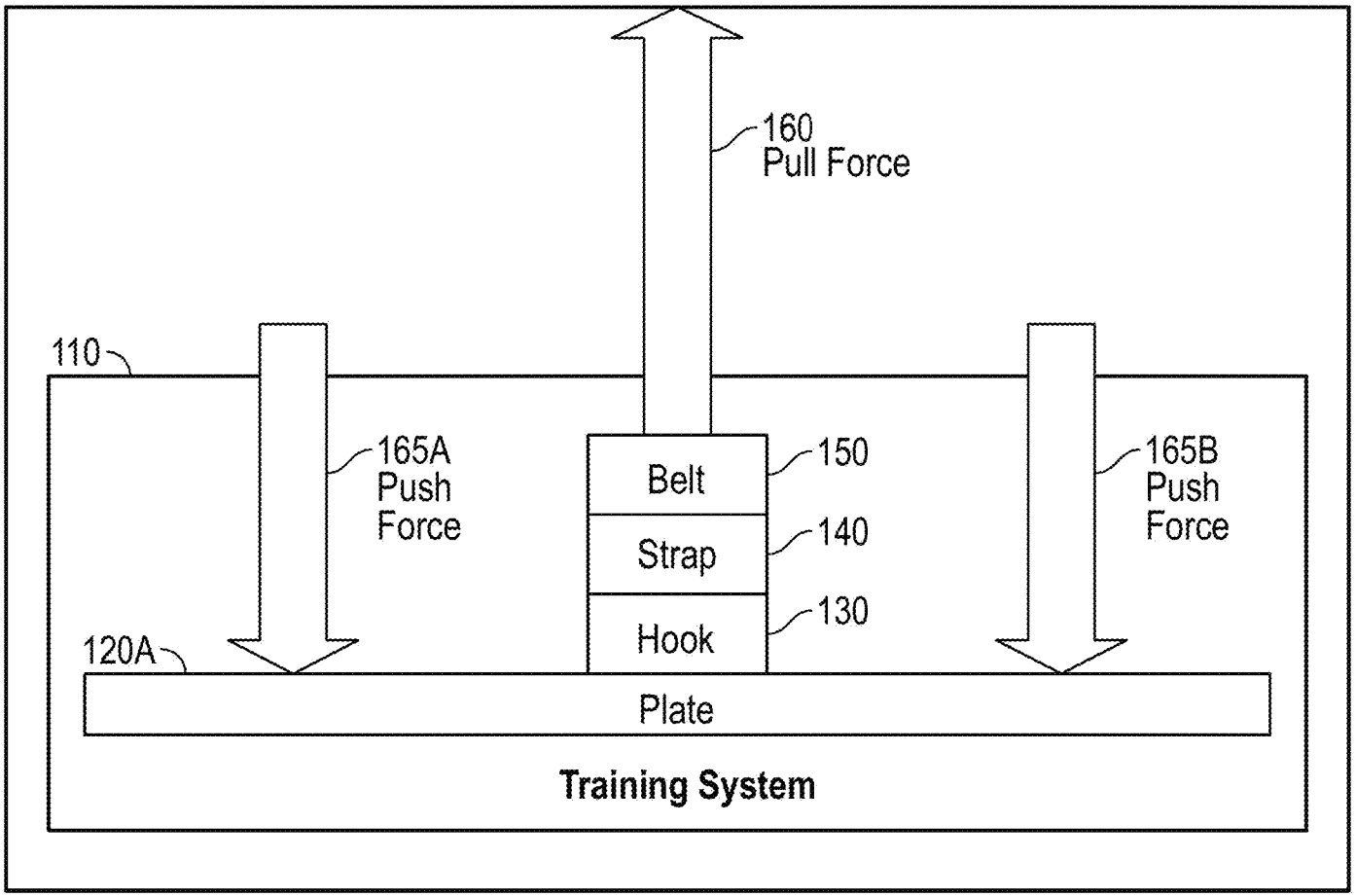
FIG. 1A illustrates a block diagram depicting an embodiment of the system for training lower extremities.

Referring now to FIG. 1A, FIG. 1A illustrates a block diagram depicting an embodiment of the training system 110 for lower extremities. The training system 110 can include a plate 120A (generally referred to as plate 120). The plate 120 can include a hook 130. The training system 110 can also include a strap 140 and a belt 150.

The plate 120 can be a metal plate configured to receive force. The plate 120 can be rectangular or any other shape. In various embodiments, the pate may be 30"×24.5"×0.5", 28"×20"×0.5", or any other suitable dimensions. The plate 120 may be aluminum and/or may include a steel sore. However, the plate 120 may be composed of any suitable material, for example a metal or other material capable of withstanding force from the user. The plate 120 can include a flat surface. For example, the plate 120 may include both an upper surface and a lower surface. In such an embodiment, the lower surface may be configured and sized to rest flat upon a gym floor, for example. The upper surface may be configured and sized to accept the user's feet. In some embodiments, the plate can include a grip for the user to stand on. In such an embodiment, the upper surface may include an additional grip surface or coating configured to enhance the grip between the user's shoes and the plate 120. In a further embodiment, the lower surface may include an additional grip surface or coating configured to increase friction between the plate 120 and the floor (for example, to decrease sliding of the plate 120).

The hook 130 may be included in the plate 120. The hook 130 may be part of the plate 120 or otherwise attached to the plate 120. The hook 130 can include a metal ring, magnetic materials, or any other attachment mechanism configured to connect to the strap 140. In an embodiment, the hook 130 includes threads and the plate 120 includes a threaded hole sized to accept the threads of the hook 130. In a further embodiment, a base 220 is disposed between the hook 130 and the plate. The base 220 may be a rectangular, generally flat, member comprising one or mounting holes 230 and one or more hook holes. The one or more mounting holes may be sized to accept fasteners, such that the fasteners may hold the base 220 to the plate. In such an embodiment, the plate may comprise an equal number of mounting receiving holes aligned with the one or more mounting holes 230 of the base 220. Similarly, the plate may include one or more hook receiving holes aligned with the one or more hook holes of the base 220. Thus, the force felt on the hook 130 during operation of the system may be distributed across the base 220, the one or more fasteners, and the plate. The hook 130 may be threaded and screwed into the base 220 and/or plate 120. However, in a further embodiment, the hook 130 may be placed in contact with the base 220, the plate, and/or any receiving holes therein, and may be welded in position. The weld may provide improved strength of the connection between the hook 130 and the plate 120. In yet a further embodiment, the base 220 may also be welded to the plate 120.

The strap 140 is an elongated flap, ribbon, or rope. In an embodiment, the strap 140 is a chain. For example, a chain strap 140 may be less likely to deform under force; thus, readings may be more accurate and consistent. The strap 140 can include a proximal end configured to couple to the hook 130. The proximal end can include a loop, a magnet, or any other attachment mechanism. The strap 140 can have a fixed length. The strap 140 may include one or more attachment rings on the proximal or distal ends. For example, such attachment rings may be metal rings configured to accept a coupling link. The fixed length can be 1, 2, 3, 4, 5, 6, 7, 8, 9, or 10 feet. The strap 140 can include leather or fabric. The strap 140 may include a webbing design such that the strap 140 is high-strength strap 140 that can maintain its structural integrity when pulled. The strap 140 can include a distal end. The distal end can include a loop, a magnet, or any other attachment mechanism configured to couple to the belt 150.

The belt 150 can be a band or strap worn around a user's waist. The belt 150 can be an athletic belt, such as those designed for weightlifting, sled training, or any other physical exercise or training. The belt 150 can be adjustable to accommodate various waist sizes. The belt 150 can include a buckle to secure the belt to the user. The belt 150 may include leather, plastic, cloth, or any other fabric. In an alternate embodiment, the belt 150 may be replaced and/or supplemented with a harness attached to the user's body. For example, the belt 150 may be replaced and/or supplemented with a should harness wrapped over the user's shoulders. In yet another alternate embodiment, the belt 150 may be replaced and/or supplemented with a bar, wherein the bar is attached to the strap 140. As a non-limiting example, the user may plant their feet on the plate 120 and grasp the bar, pulling upwards on the bar, such that a force is felt downward on the plate 120. Utilization of a bar may enable the system to accurately target and/or incorporate upper body extremities.

When the user stands on the plate 120A while wearing the belt 150 connected to the plate 120 via the strap 140 and hook 130, the user can exert a pull force 160 away from the plate 120. Since the user is standing on the plate 120A, the user would simultaneously exert pushing forces 165A-B (generally referred to as push force 165) on the plate 120A. For example, the user can exert push force 165A with one leg, and push force 165B with their other leg.

However, the training system 110 can accommodate any number of push forces 165 from the user. For example, a disabled user may exert only one push force 165 or any number of push forces 165. However, the plate 102 may be sized such that a force applied solely on one side of the plate 102 does not cause the plate 102 to flip or slip from under the user. For example, the plate 102 may be sufficiently weighted and/or a suitable width to maintain the position of the plate 102 regardless of the magnitude or direction of force acted upon it.

Figure 1B:
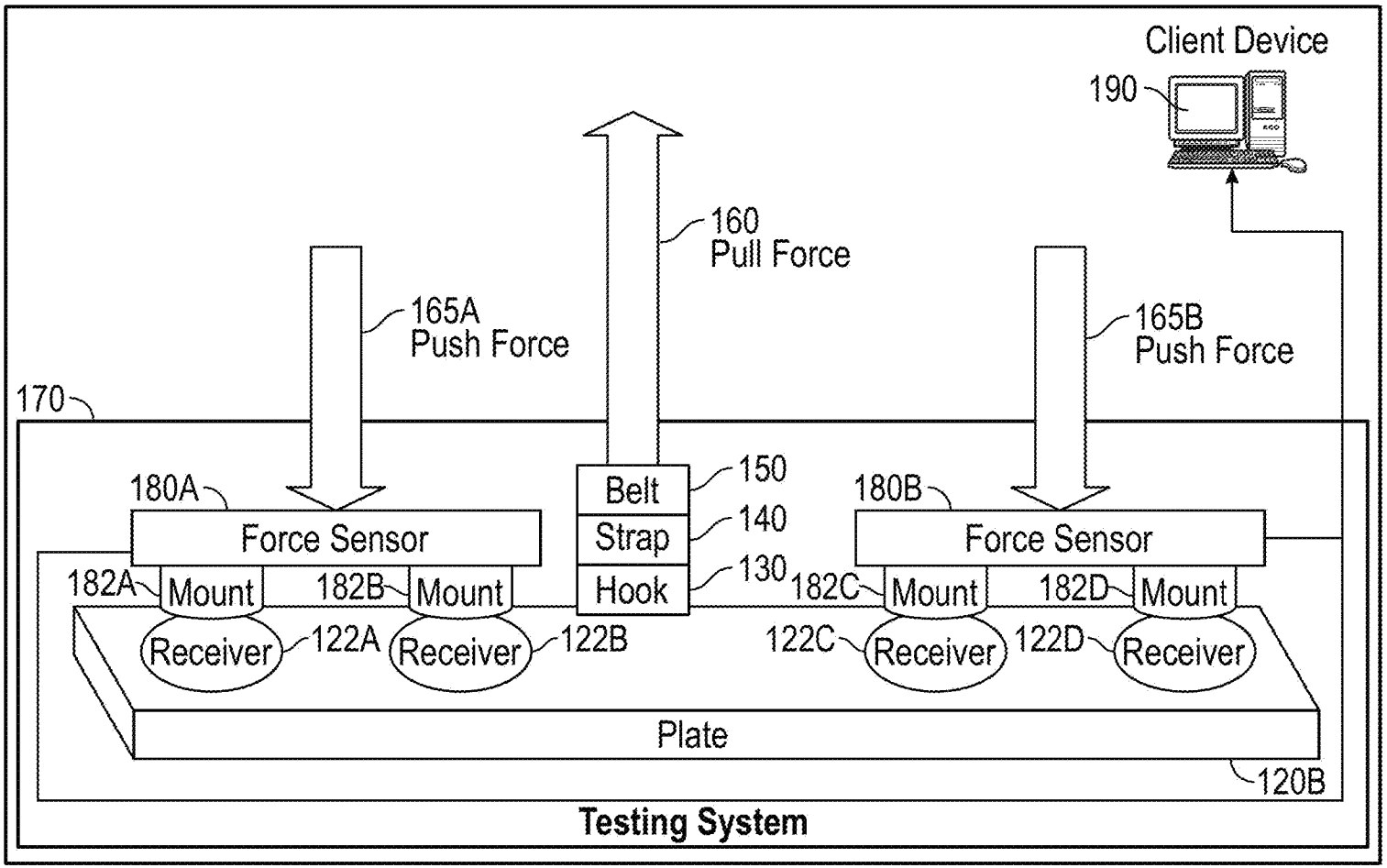
FIG. 1B illustrates a block diagram depicting an embodiment of the system for testing lower extremities.

Referring now to FIG. 1B, FIG. 1B illustrates a block diagram depicting an embodiment of a testing system 170 for lower extremities. The testing system 170 can include the hook 130, the strap 140, and the belt 150 as previously described herein. The testing system 170 can also include a plate 120B, which includes one or more receivers 122A-122D (generally referred to as receivers 122). The testing system 170 can further include force sensors 180A-180B (generally referred to as force sensor 180), which include mounts 182A-182D (generally referred to as mounts 182).

The receivers 122 can be disposed anywhere on the plate 120B. Each receiver 122 can be a hole, cavity, or a port drilled or engraved into the plate 120B. In a further embodiment, described herein, each receiver 122 may be a section of friction enhancing material or grip tape sized to accept the one or more mounts 182. The receiver 122 may include dimensions for receiving corresponding mounts 182 from any number of force sensors 180. The receivers 122 can include magnets or any other attachment mechanism to couple to the corresponding mounts 182 from the force sensors 180. However, in an embodiment, the mounts 182 rest atop or partially within the receivers 122 without the use of additional attachment mechanisms. In such an embodiment, the push force 165 may aid in maintaining the position of the mounts 182 over the receivers 122.

The force sensor 180 can measure forces applied to the force sensor 180. The force sensor 180 can be a force plate such as, but not limited to, those provided by HAWKIN DYNAMICS of Westbrook, Me. The force sensor 180 can be a single force plate or a bilateral force plate. The force sensor 180 can include load cells that measure values corresponding to the push forces 165 applied to the load cells. The force sensor 180 can transmit the values to the client device 190, for example via Bluetooth. The force sensor 180 can include mounts 182.

The mounts 182 can couple to the receivers 122 to couple the force sensor 180 to the plate 120B. The mounts 182 can extend from the force sensor 180 to position the force sensor on the plate 120B. The mounts 182 can include metallic rods, magnets, or any other attachment mechanism. The mounts 182 can couple to the receivers 122 such that the force sensor 180 remains stationary on the plate 120B regardless of any vertical or horizontal force applied to the testing system 170.

The client device 190 can interface with the force sensor 180. The client device 190 can be a computer, a display, or a fitness tracker. The client device 190 can notify the user to begin exerting the pulling force 160, and later to stop exerting the pulling force 160. For example, the client device 190 can display a notification or generate a sound requesting the user to begin exerting the pulling force 160. The client device 190 can also request that the user stops exerting the pulling force 160 after a predetermined amount of time, or after the client device 190 collects a predetermined amount of data from the force sensors 180. The client device 190 can receive, from the force sensor 180, the values corresponding to the force exerted on the force sensor 180. The client device 190 can communicate with the force sensor 180 via a network, a wired connection, or a wireless connection. The client device 190 can determine the force exerted on the force sensor 180 from the values received from the force sensor 180. The client device 190 can display the force in a graphical user interface displayed on a screen of the client device 190. The client device 190 can also transmit the force values to another system or device. For example, the client device 190 can transmit the force to a fitness tracker via Bluetooth.

When the user stands on the force sensors 180A-180B while wearing the belt 150 connected to the plate 120B via the strap 140 and hook 130, the user can exert the pull force 160 away from the plate 120B. Since the user is standing on the force sensors 180A-180B mounted on the plate 120B, the user would simultaneously exert the pushing forces 165A-B on the force sensors 180A-180B. For example, the user can exert the push force 165A on the force sensor 180A with one leg, and the push force 165B on the force sensor 180B with their other leg.

Although the testing system 170 illustrated in FIG. 1B depicts two force sensors 180, one for each leg, it is contemplated that the training system 110 can accommodate any number of push forces 165 from the user. For example, a disabled user may exert only one push force 165 on one force sensor 180 or any number of push forces 165 on a corresponding number of force sensors 180.

Figure 2:
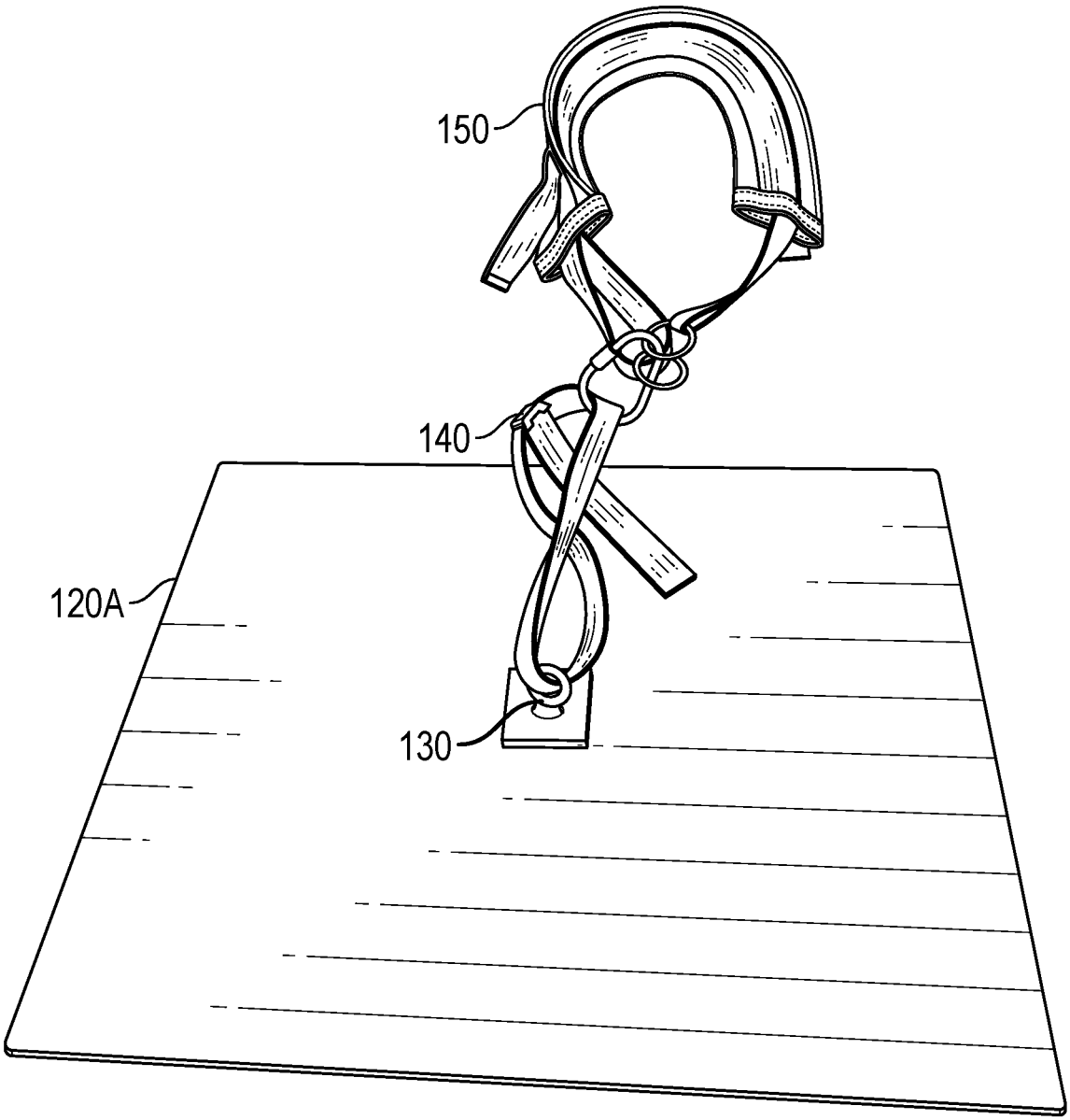
FIG. 2 illustrates a view of the belt attached to the strap, which is attached to the hook of the plate in an exemplary embodiment of the system for training lower extremities.

Referring now to FIG. 2, FIG. 2 illustrates a view of the plate 120A, hook 130, strap 140, and belt 150 in an exemplary embodiment of the training system 110. By having the training system 110 have individual parts, the user can replace parts or position themselves according to their preferences. For example, the user can replace the belt or choose a preferred belt without modifying the training system 110. The belt 150 may be attached to the strap 140, which may attach to the hook 130 of the plate 120A in an exemplary embodiment of the training system 110. For example, the user can attach the hook 130 to the strap 140 and then attach the strap 140 to the belt 150. Then the user could stand on the plate 120A and secure the belt 150 to their waist to use the training system 110.

Figure 3:
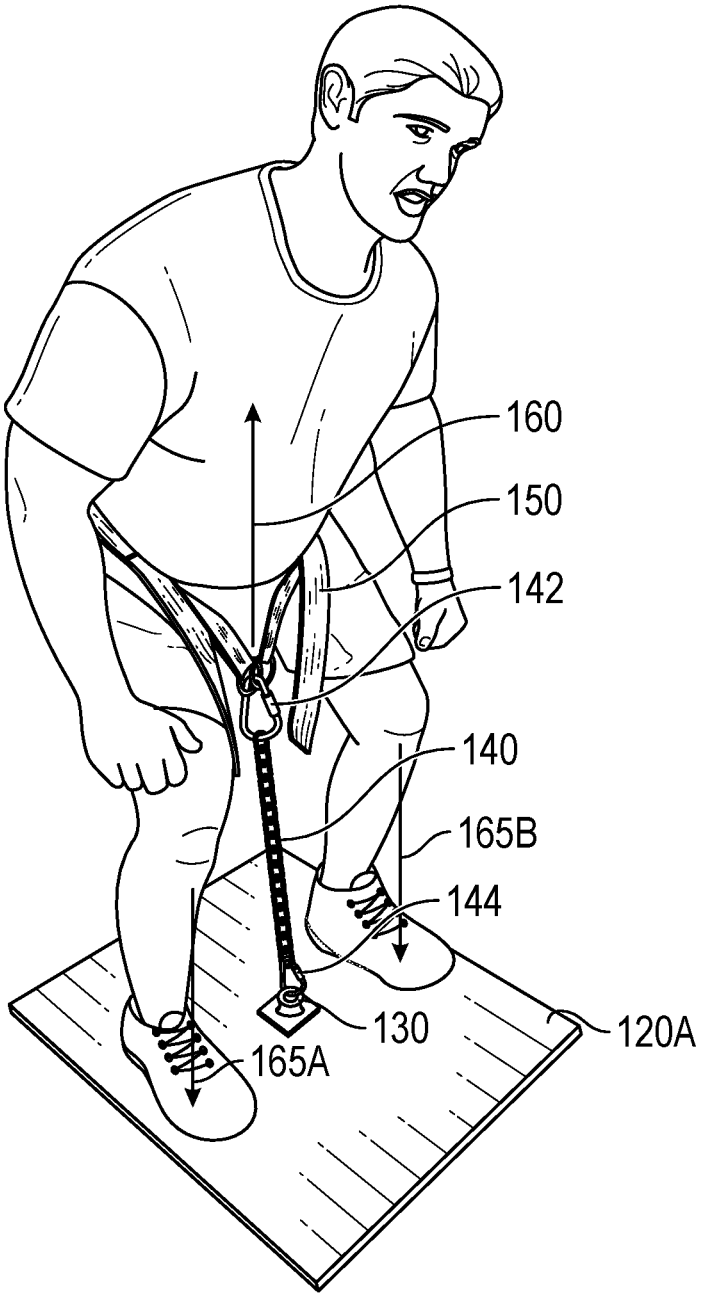
FIG. 3 illustrates a view of the user performing an IMTP by exerting a pulling force on the plate, which causes the user to exert a pushing force on the plate in an exemplary embodiment of the system for training lower extremities.

Referring now to FIG. 3, FIG. 3 illustrates a view of the user performing an IMTP by exerting the pulling force 160 on the plate 120A, which causes the user to exert the pushing forces 165 on the plate 120A in an exemplary embodiment of the training system 110. By having the belt 150 around their midsection, the user can use their lower extremities, such as the thigh muscles, to exert a pulling force and thus exert a pushing force on the plate 120A. Further, a coupling link 142 and/or a quick link 144 may be attached to the strap 140. For example, a coupling link 142 may be disposed between the strap 140 and the belt 150 and a quick link 144 may be disposed between the strap 140 and hook 130. The quick link 144 may be configured to easily attach and reattach to the hook 130, while also maintaining a secure and safe connection to the hook 130. The coupling link 142 may be adjustable, enabling the user to draw the strap 140 through the coupling link 142 to lengthen or shorten the strap portion disposed between the coupling link 142 and the quick link 144.

Figure 4:
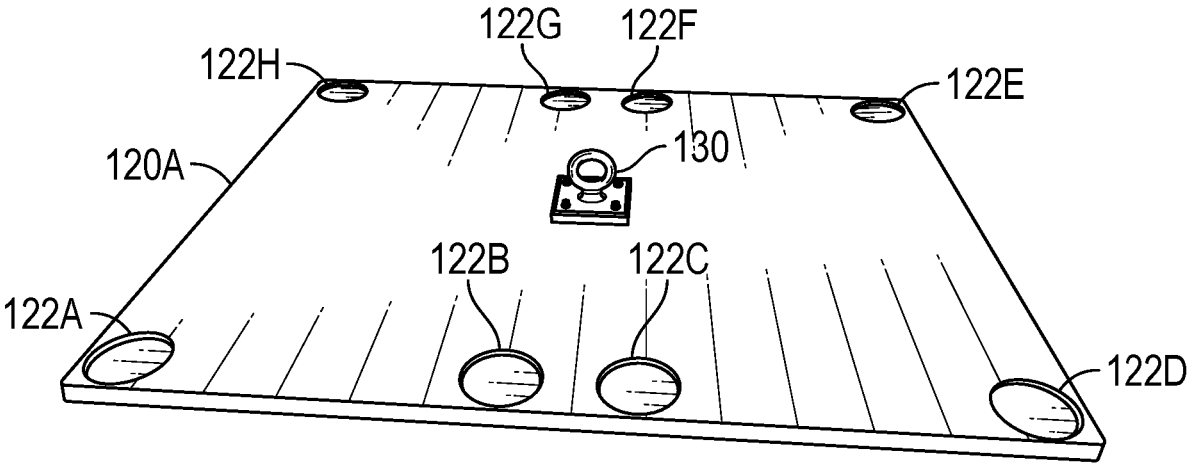
FIG. 4 illustrates a view of the plate having mounting holes in an exemplary embodiment of the system for testing lower extremities.

Referring now to FIG. 4, FIG. 4 illustrates a view of the plate 120B having receivers 122A-122H in an exemplary embodiment of the testing system 170. The receivers 122A-122H can each have a depth such that each receiver 122 forms an inner cylinder in the plate 120B for receiving corresponding mounts 182.

Figure 5:
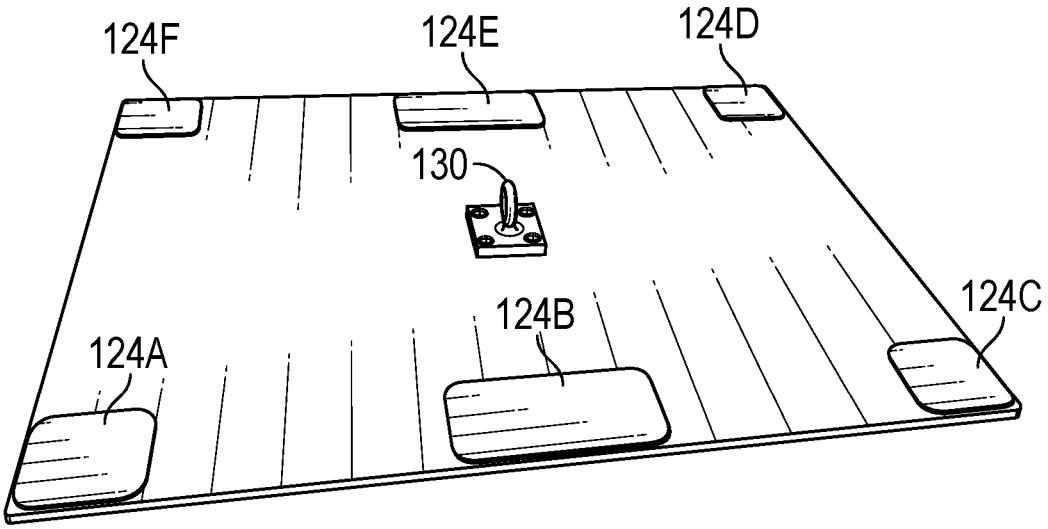
FIG. 5 illustrates a view of the plate having a plurality of receiving surfaces in an exemplary embodiment of the system for testing lower extremities.

Referring now to FIG. 5, FIG. 5 illustrates a view of the plate 120 having receiving surfaces 124 disposed on the plate surface. The receiving surfaces 124 may be a friction enhancing material and/or a grip tape. Each grip tape section 124A-124F may referred to as receiving surfaces 124, generally. Each section of grip tape may be positioned on the plate 120 to accept the mounts 182 of the force sensors 180. In one embodiment, the plate 120 may include six grip tape sections 124A-124F, wherein four of the grip tape sections 124A/124C/124D/124F are positioned in the corners of the upper surface of the plate 120 and two of the grip tape sections 124B/124E are positioned equidistant from the corner sections of the grip tape 124A/124C/124D/124F along the length of the plate 120. The two sections of grip tape 124B/124E may comprise a greater surface area such that these two sections of grip tape 124B/124E may accept two mounts 182 (for example, one mount from each force sensor 180).

Figure 6A:
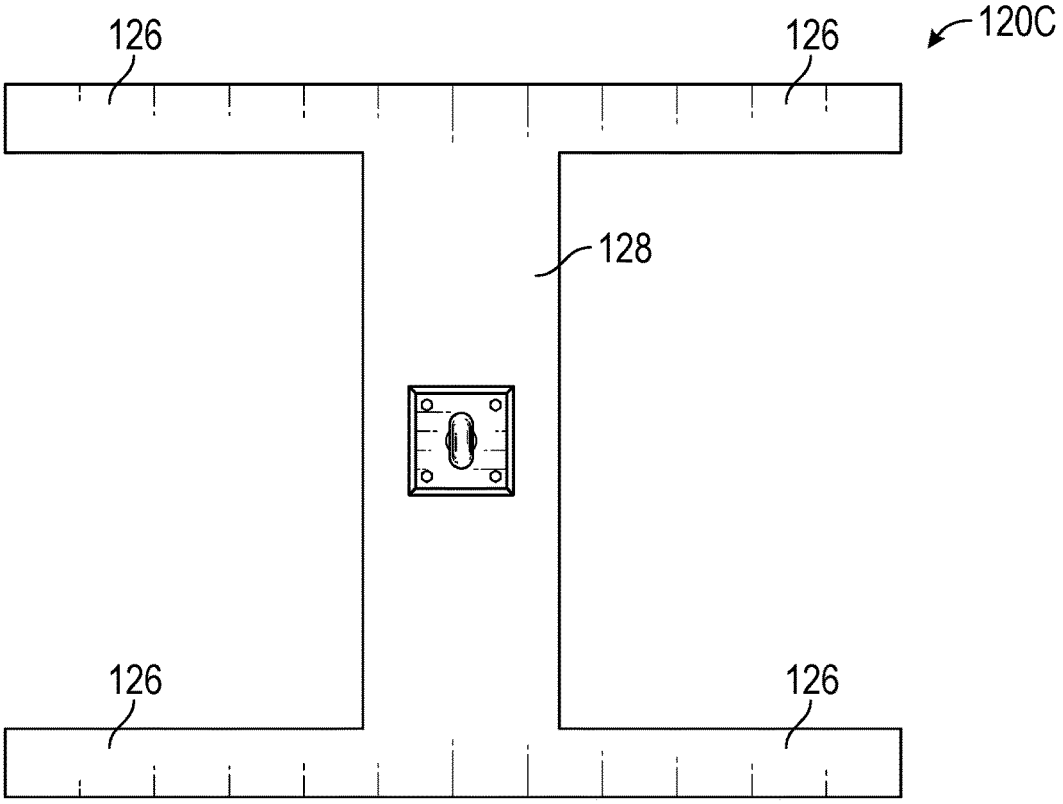
FIGS. 6A-6B illustrate views of embodiments of plates with reduced footprints.
Figure 6B:
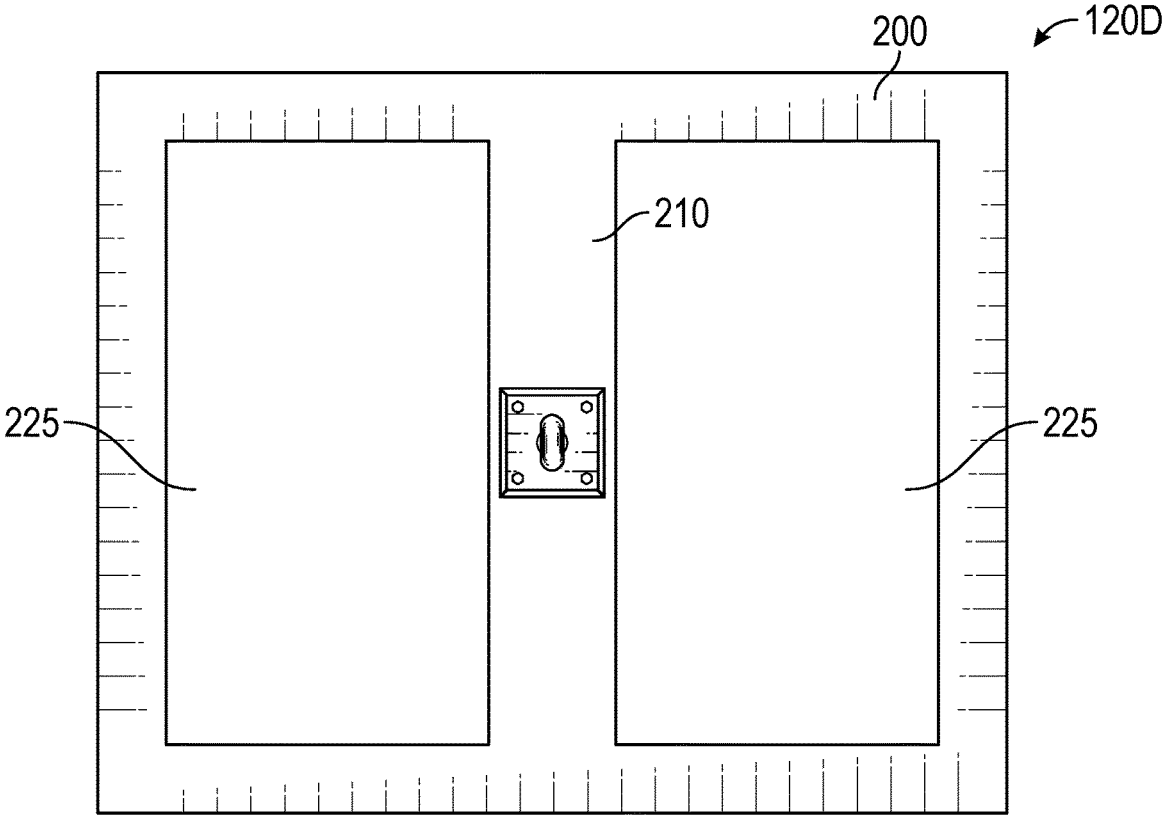

Referring not to FIGS. 6A-6B, FIGS. 6A-6B illustrate view of the plates having reduced footprints. The plate 120C may include a central section 128 and one or more wings 126. Accordingly, the wings 126 may be sized to accept the mounts 182 of the force sensors 180. Thus, a gap may exist between opposite wings 126, for example, to reduce the weight and footprint of the plate 120C while maintaining a sufficient surface area to accept the force sensors 180. The plate 120D may include one or more apertures 225. In such an embodiment, plate 120D comprises a central section 210 and a perimeter 200. The central section 210 may be configured to accept the hook 130 and the perimeter 200 may be sized to accept the mounts 182 of the force sensors 180. Accordingly, the plate 120D may be a structurally sound member sized to accept one or more force sensors 180, yet a reduced weight and foot print.

Figure 7:
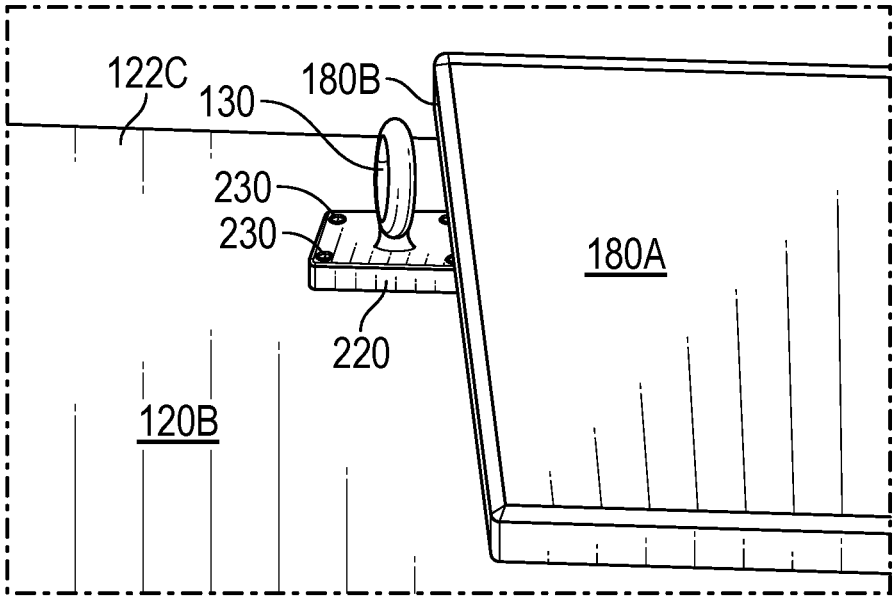
FIG. 7 illustrates a side view of the plate having mounts and attached to the force sensor in an exemplary embodiment of the system for testing lower extremities.

Referring now to FIG. 7, FIG. 7 illustrates a side view of the plate 120B having receivers 122 and attached to the force sensor 180A in an exemplary embodiment of the testing system 170. In the exemplary embodiment, since the hook 130 is on the plate 120B between the force sensor 180A and the receiver 122C for the force sensor 180B, the strap 140 can attach to the hook 130 without interfering with the force sensors 180. In an embodiment, the system may comprise the plate 120B, the hook 130, the receivers 122, and the force sensor 180B. The force sensor 180A may be on the plate 120B. The remaining receivers 122 can receive the mounts 182 of the force sensor 180B. In an embodiment, the hook 130 is positioned such that the plane of the hook 130 eye is parallel to the force sensors. Accordingly, by positioning the hook 130 parallel to the force sensors, the force sensors may clear the hook 130.

Figure 8:
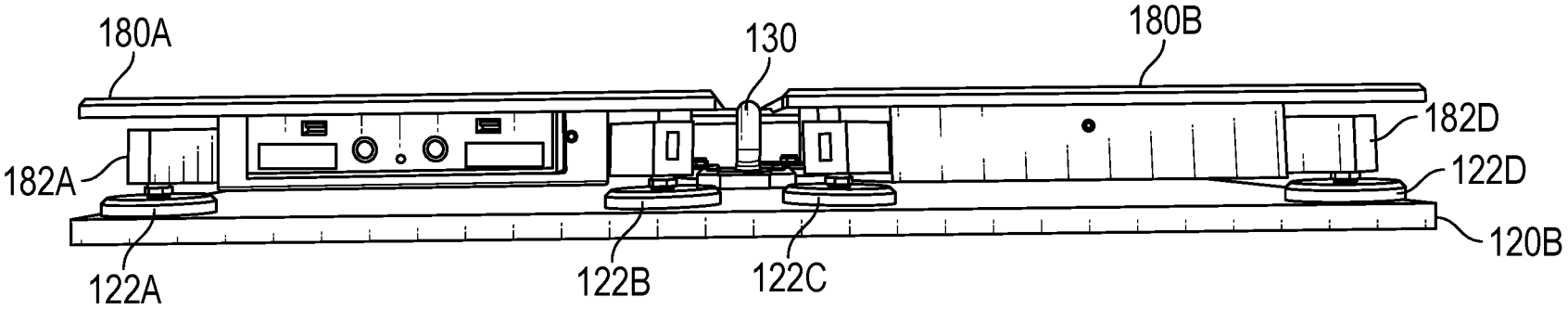
FIG. 8 illustrates a side view of the plate, the receivers, the hook, the force sensor, and the mounts of the system for testing lower extremities.

Referring now to FIG. 8, FIG. 8 illustrates a side view of the plate 120B, the receivers 122, the hook 130, the force sensors 180, and the mounts 182 of the testing system 170. In the exemplary embodiment, a user can step on the force sensors 180 and then attach themselves to the plate 120B via the hook 130 exposed between the force sensors 180.

Figure 9:
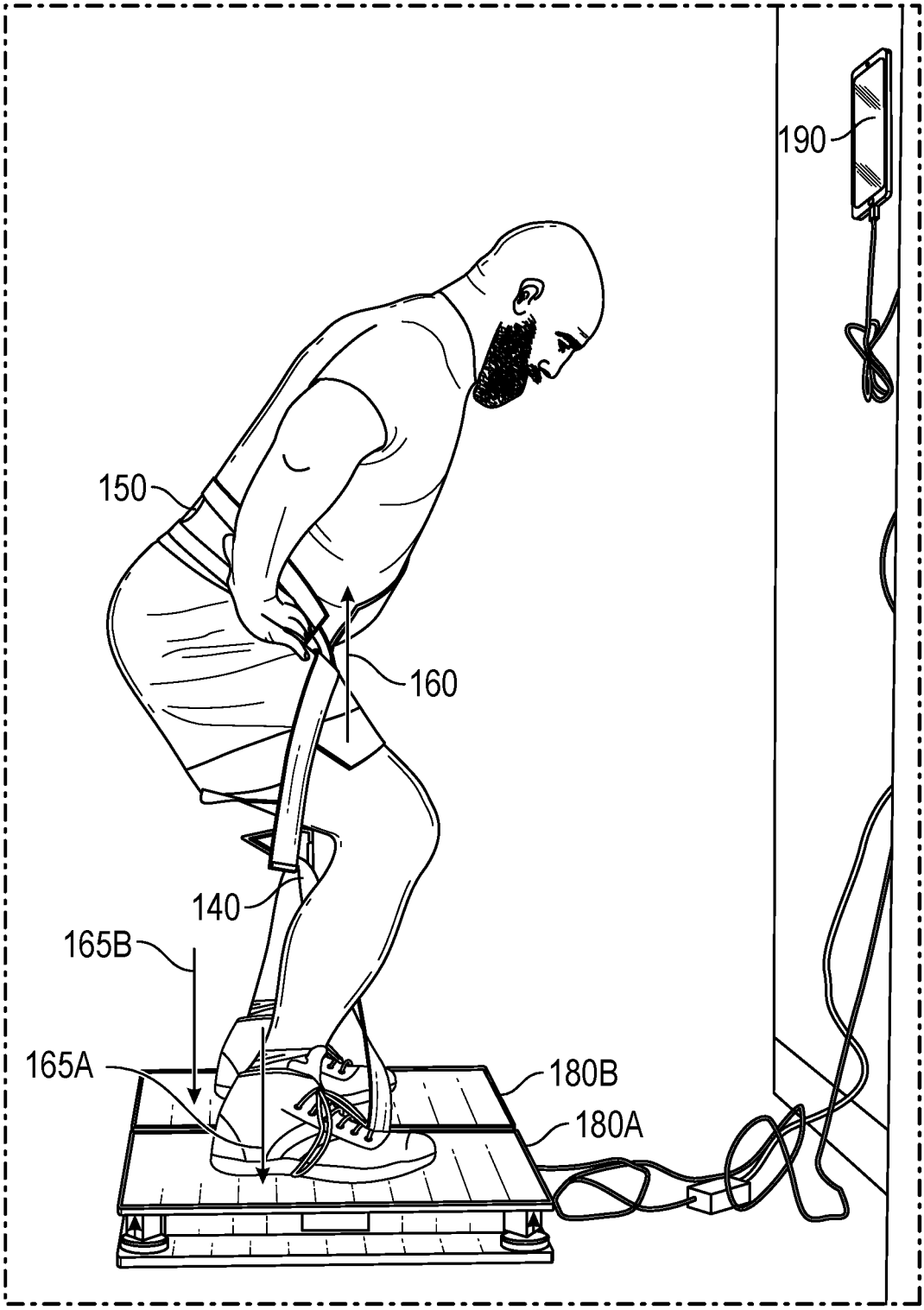
FIG. 9 illustrates a view of the user performing the IMTP by exerting the pulling force on the plate, which causes the force sensors to transmit measurements of the corresponding push forces to the client device in an exemplary embodiment of the system for testing lower extremities.

FIG. 9 illustrates a view of the user performing the IMTP by exerting the pulling force 160 on the plate 120B, which causes the force sensors 180 to transmit measurements of the corresponding push forces 165 to the client device 190 in an exemplary embodiment of the testing system 170. The client device 190 may display a total of the push forces 165 exerted by the user. The client device 190 can display the total as a unit of measurement such as Newton's.

Figure 10:
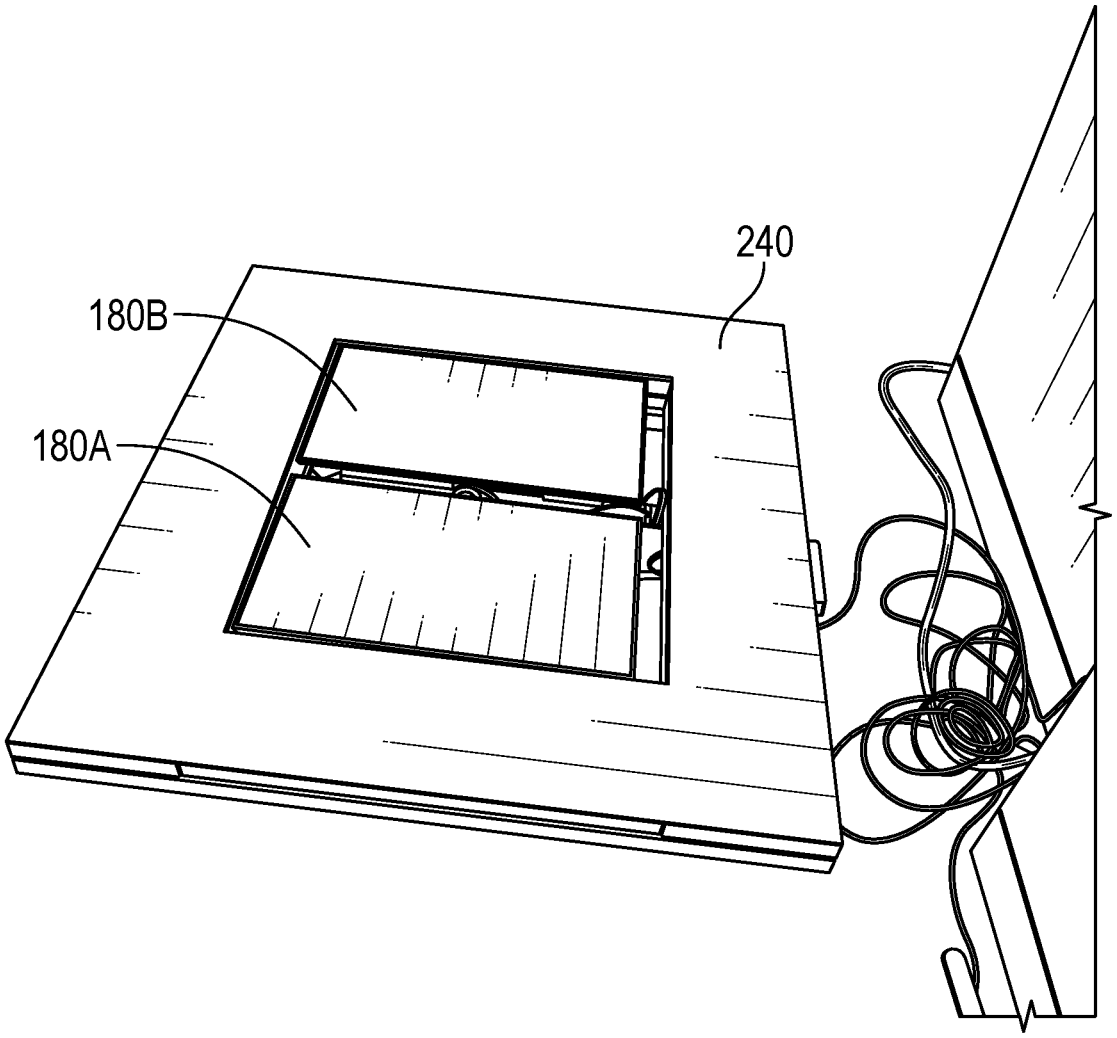
FIG. 10 illustrates a view of an embodiment of the system further comprising a border.

Referring now to FIG. 10, FIG. 10 illustrates a further embodiment of the system comprising a border 240. The border 240 may be an annular member surrounding the perimeter of the plate 120 and/or force sensors. The border 240 may be sized to have the same height as the top surface of the force sensors. Accordingly, the border 240 may be configured to act as a safety feature. For example, the border 240 may provide a surface for the user to step upon after operating the force sensors. Additionally, the border 240 may be a surface that reduces the likelihood of the user injuring themselves while jumping on the force sensors.

Figure 11:
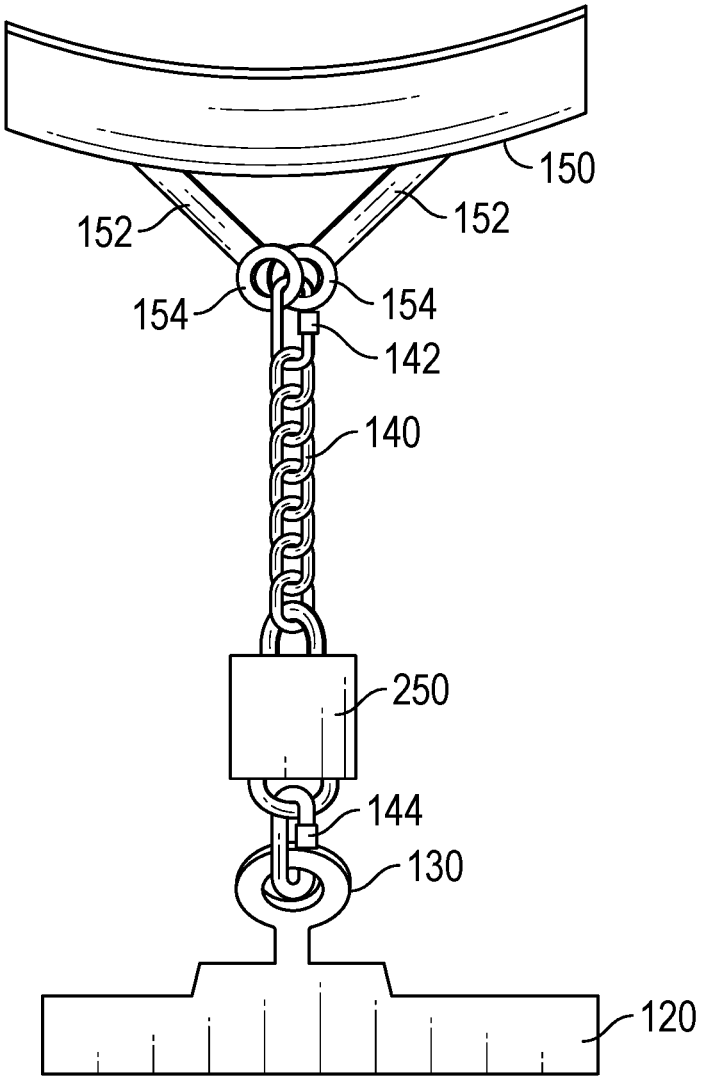
FIG. 11 illustrates a view of the system including an inline force sensor.

Referring now to FIG. 11, FIG. 11 illustrates an alternate embodiment of the system including an inline force sensor 250. In such an embodiment, belt 150 may be tethered to a coupling link. The coupling link may be coupled to a strap 140 (for example, a chain). Further, the strap 140 may be attached to an inline force sensor 250 and the inline force sensor 250 may be further connected to a quick link. The quick link may be reversibly attached to the hook 130. Thus, when the user exerts a downward force, the inline force sensor 250 may determine the magnitude of such a force. In this way, the inline force sensor 250 may determine and transmit data in a manner similar to that of the force sensors. Accordingly, in such an embodiment comprising the inline force sensor 250, the testing system 170 may not include force sensors. Thus, the testing system 170, in this alternate embodiment, may function with the plate 120A. The belt 150 may include one or more subbelts 152 and/or one or more metal rings 154.

The client device 190 can also notify the user when to begin exerting the pulling force 160 and when to stop exerting the pulling force 160.

Various elements, which are described herein in the context of one or more embodiments, may be provided separately or in any suitable subcombination. Further, the processes described herein are not limited to the specific embodiments described. For example, the processes described herein are not limited to the specific processing order described herein and, rather, process blocks may be re-ordered, combined, removed, or performed in parallel or in serial, as necessary, to achieve the results set forth herein.

It will be further understood that various changes in the details, materials, and arrangements of the parts that have been described and illustrated herein may be made by those skilled in the art without departing from the scope of the following claims.

All references, patents and patent applications and publications that are cited or referred to in this application are incorporated in their entirety herein by reference. Finally, other implementations of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

The invention claimed is:

1. A lower extremity training system comprising:

a plate comprising:

one or more grip sections configured to accept one or more mounts, wherein the one or more mounts are coupled to one or more force sensors, an upper surface, and a lower surface, wherein the lower surface is configured to interface with a floor;

a hook orthogonal to the upper surface;

a strap reversibly coupled to the hook; and a belt reversibly coupled to the strap, the belt sized to conform to a waist of a user, wherein the strap includes a fixed length, and wherein a pull force, originating at the belt, exerted away from the upper surface induces one or more push forces towards the upper surface.

2. The lower extremity training system of claim 1, wherein the strap is reversibly coupled to the hook via a quick link, and wherein the quick link is disposed between the strap and the hook.

3. The lower extremity training system of claim 2, wherein the strap is reversibly coupled to the belt via a coupling link, and wherein the coupling link is disposed between the strap and the belt.

4. The lower extremity training system of claim 1, further comprising a base disposed between the hook and the plate.

5. The lower extremity training system of claim 4, the base further comprising one or more mounting holes and a hook hole, wherein the one or more mounting holes are threaded such as to accept one or more fasteners, one or more fasteners are configured to affix the base to the plate, and wherein the hook hole is sized to accept the hook.

6. The lower extremity training system of claim 5, wherein the hook is welded to the base.

7. A lower extremity testing system comprising:

a plate comprising:

one or more grip sections configured to accept one or more mounts, wherein the one or more mounts are coupled to one or more force sensors, an upper surface, and a lower surface, wherein the lower surface is configured to interface with a floor;

a hook orthogonal to the upper surface;

a strap reversibly coupled to the hook;

a belt reversibly coupled to the strap, the belt sized to conform to a waist of a user; wherein the strap includes a fixed length, and wherein a pull force, originating at the belt, exerted away from the upper surface induces one or more push forces towards the upper surface; and the one or more force sensors configured to sense the one or more push forces and determine a magnitude of the one or more push forces.

8. The lower extremity testing system of claim 7, the plate further comprising one or more receivers sized to accept the one or more mounts, wherein the one or more mounts are coupled to the one or more force sensors.

9. The lower extremity testing system of claim 7, the plate further comprising one or more apertures, a central section, and a perimeter, wherein the hook is disposed above the central section, wherein the perimeter surrounds the one or more apertures, and wherein the one or more grip sections are disposed on the perimeter.

10. The lower extremity testing system of claim 7, wherein the strap is reversibly coupled to the hook via a quick link, and wherein the quick link is disposed between the strap and the hook.

11. The lower extremity testing system of claim 10, wherein the strap is reversibly coupled to the belt via a coupling link, and wherein the coupling link is disposed between the strap and the belt.

12. The lower extremity testing system of claim 7, further comprising a base disposed between the hook and the plate.

13. The lower extremity testing system of claim 12, the base further comprising one or more mounting holes and a hook hole, wherein the one or more mounting holes are threaded such as to accept one or more fasteners, the one or more fasteners are configured to affix the base to the plate, and wherein the hook hole is sized to accept the hook.

14. The lower extremity testing system of claim 13, wherein the hook is welded to the base.

15. The lower extremity testing system of claim 7, wherein the one or more force sensors is an inline force sensor, wherein the inline force sensor is coupled to the strap.

16. The lower extremity testing system of claim 7, further comprising a client device in electrical communication with the one or more force sensors, wherein the client device is configured to display a user interface, and wherein the user interface comprises one or more metrics, the one or more metrics being a function of the magnitude of the one or more push forces.

17. The lower extremity testing system of claim 7, further comprising a border surrounding at least the plate, wherein the border includes a border height, wherein the one or more force sensors include a sensor height, and wherein the border height is equivalent to the sensor height.

* * * * *